United States Patent [19]

Bryan

[11] Patent Number: 4,998,615

[45] Date of Patent: Mar. 12, 1991

[54] COMPOSITE TRAY AND STACKER FOR A SHRINK WRAPPED PACKAGE

[76] Inventor: Robert M. Bryan, P.O. Box 35664, Edina, Minn. 55435

[21] Appl. No.: 415,778

[22] Filed: Oct. 2, 1989

[51] Int. Cl.[5] ..... B65D 5/48; B65D 5/50; B65D 65/02

[52] U.S. Cl. ..... 206/44.12; 206/45.33; 206/497; 229/127; 229/164; 229/919

[58] Field of Search ..... 206/497, 45.33, 44.12; 229/127, 164, 120.18, DIG. 12, DIG. 2, 919

[56] References Cited

U.S. PATENT DOCUMENTS

| | | | |
|---|---|---|---|
| 2,741,415 | 4/1956 | Meitzen | 229/DIG. 2 X |
| 3,348,667 | 10/1969 | Beeby | 206/45.33 |
| 3,493,106 | 2/1970 | Galli | 206/497 |
| 3,493,107 | 2/1970 | Markey | 206/497 X |
| 3,595,384 | 7/1971 | Sargent et al. | 206/432 |
| 3,826,357 | 7/1974 | Roth | 206/45.33 |
| 3,942,631 | 3/1976 | Sutherland et al. | 206/44.12 |
| 3,993,239 | 11/1976 | Exel | 229/919 X |
| 4,062,448 | 12/1977 | Meighan | 206/497 X |
| 4,427,108 | 1/1984 | Coles et al. | 206/45.33 |
| 4,475,653 | 10/1984 | Ullman | 206/497 |

*Primary Examiner*—Paul T. Sewell
*Assistant Examiner*—Jacob K. Ackun, Jr.
*Attorney, Agent, or Firm*—Burd, Bartz & Gutenkauf

[57] ABSTRACT

A composite tray and stacker for shrink wrapped packages of a plurality of identical paperboard and/or plastic containers supported in a tray for the purpose of providing compressive load-bearing capability to the package. The composite tray and stacker is composed essentially of a single sheet of stiff material, such as corrugated paperboard. The structure includes a rectangular tray bottom wall, a pair of narrow side walls connected to opposite sides of the bottom wall along spaced apart fold lines and having fastening tabs for assembly, and a pair of end walls connected to the bottom wall along fold lines. A pair of spacer elements are foldably connected along the top edges of the end walls and a pair of weight-bearing stacker elements are foldably connected to the spacer elements. In the assembled package the end walls and spacer elements lie in parallel spaced apart relation to support packages stacked one on another.

11 Claims, 3 Drawing Sheets

COMPOSITE TRAY AND STACKER FOR A SHRINK WRAPPED PACKAGE

FIELD OF THE INVENTION

1. Background of the Invention

This invention relates to a composite tray and stacker for shrink wrapped packages of a plurality of identical paperboard and/or plastic containers supported in the tray for the purpose of providing compressive load-bearing capability to the package.

For many goods the packing of multiple containers in a relatively shallow base tray surrounded by a transparent shrinkable plastic wrap, instead of a conventional corrugated cardboard carton, has been commonplace. With the increasing popularity of warehouse-type grocery stores and supermarkets, such packages offer convenience in that upon removal of the plastic wrap, the entire package may be shelved or stacked for display purposes. Where the goods themselves have considerable load-bearing strength, such as canned goods and glass bottled goods, such shrink wrapped packages can readily be stacked. Shrink wrapped packages of lighter weight paperboard and/or plastic containers often lack significant compressive load-bearing strength so that, if stacked too high, one or more of the containers in the lowermost package may become crushed or rupture. Whether the contained goods are liquids or flakes or powders, an undesirable mess is created which may ruin not only the goods in the package including the ruptured container, but adjacent packages as well. The present invention is directed to the alleviation of this problem, as well as the added efficiency and convenience of having the tray and stacker structure formed from a single piece of corrugated sheet material.

2. The Prior Art

Prior attempts to increase the load-bearing capacity of packages of varying kinds are exemplified by the following United States Patents:

Kim: 3,327,919, June 27, 1967
Sargent et al: 3,595,384, July 27, 1971
Roth: 3,826,357, July 30, 1974
Meighan: 4,062,448, Dec. 13, 1977
Schwaner: 4,251,020, Feb. 17, 1981

No patent is known in which the supporting tray and stacker structure are formed in one composite piece.

SUMMARY OF THE INVENTION

The present invention is directed to a shrink wrapped package of a plurality of identical paperboard and/or plastic containers contained in a tray with a composite built-in stacker structure. The composite tray and stacker structure includes a rectangular tray bottom wall with a pair of relatively narrow side walls connected to opposite sides of the bottom wall along spaced apart parallel fold lines. The side walls each have a pair of fastening tabs foldably connected at the opposite ends. A pair of relatively wider rectangular end walls are connected along their bottom edges to opposite ends of the tray bottom wall along spaced apart parallel fold lines. The end walls are of a width approximately equal to the height of the containers to be packaged and are engageable by the fastening tabs of the side walls. A pair of rectangular spacer elements are each connected along one edge to the top edge of each of the end walls along a fold line. A pair of rectangular weight-bearing stacker elements are each connected to one of the spacer elements along a fold line opposite from the spacer connection to the end walls. The width of the stacker elements is approximately equal to the width of the end walls. Depending upon the number and configuration of the containers to be supported by the tray and the width of the spacer elements, the stacker elements may abut in the center of the package or may be spaced apart to separate rows of the containers.

BRIEF DESCRIPTION OF THE DRAWINGS

The invention is illustrated in the accompanying drawings in which corresponding parts are identified by the same numerals and in which.

DETAILED DESCRIPTION OF THE PREFERRED EMBODIMENT

Figures 1, 2, 3, 4:
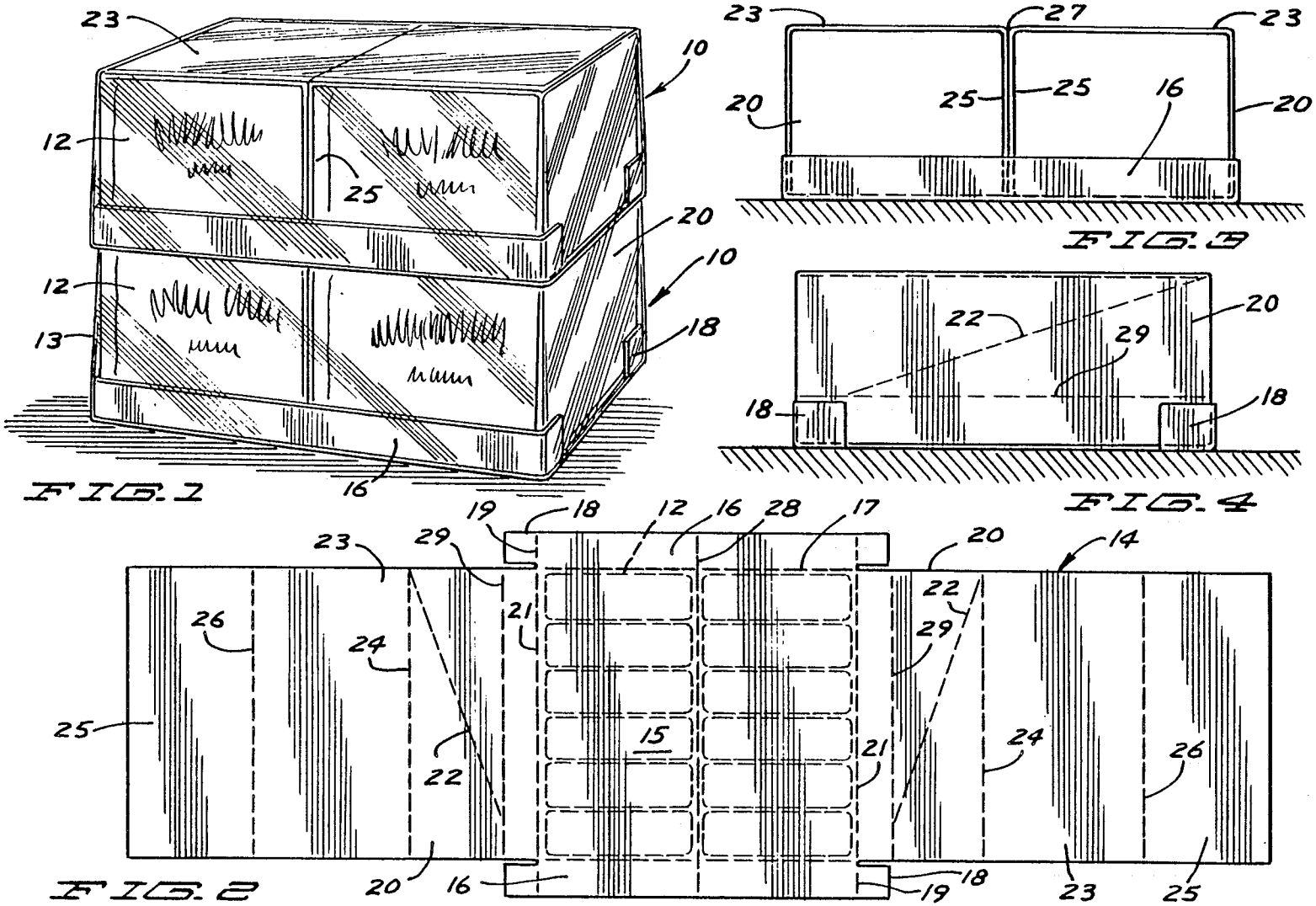
FIG. 1 is a perspective view showing two typical shrink wrapped packages according to the present invention stacked one upon the other.
FIG. 2 is a plan view of the sheet material blank from which a composite tray and stacker may be formed.
FIG. 3 is a front elevation of an assembled tray and stacker before application of a shrink wrap.
FIG. 4 is an end elevation thereof.
Figure 5:
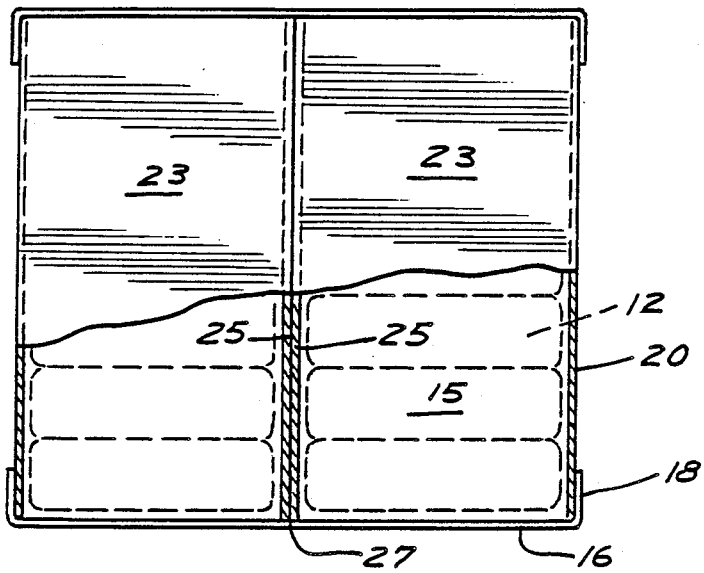
FIG. 5 is a top plan view thereof partly broken away to show underlying structure.
Figure 6:
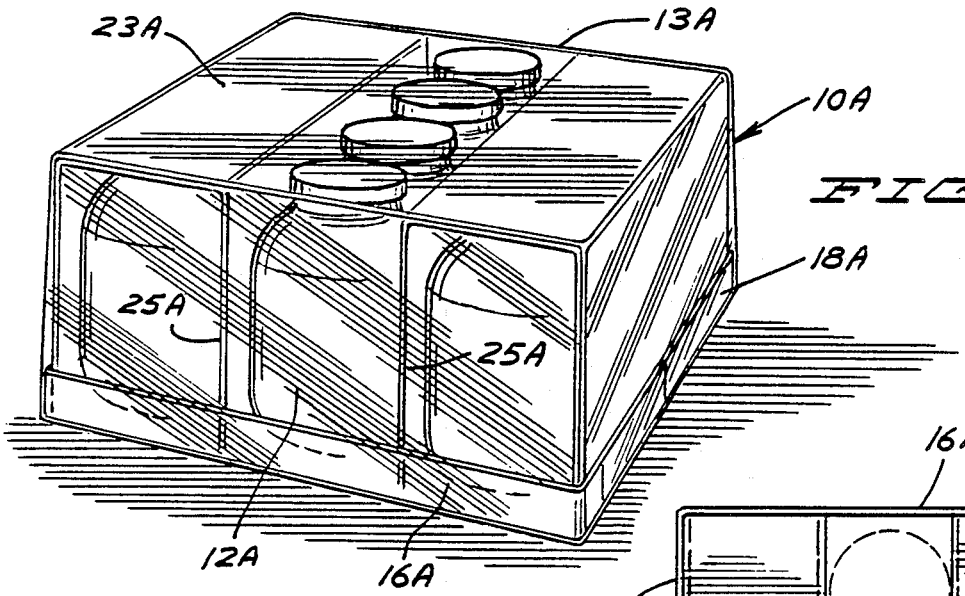
FIG. 6 is a perspective view of a shrink wrapped package formed from an alternative composite tray and stacker.
Figure 9:
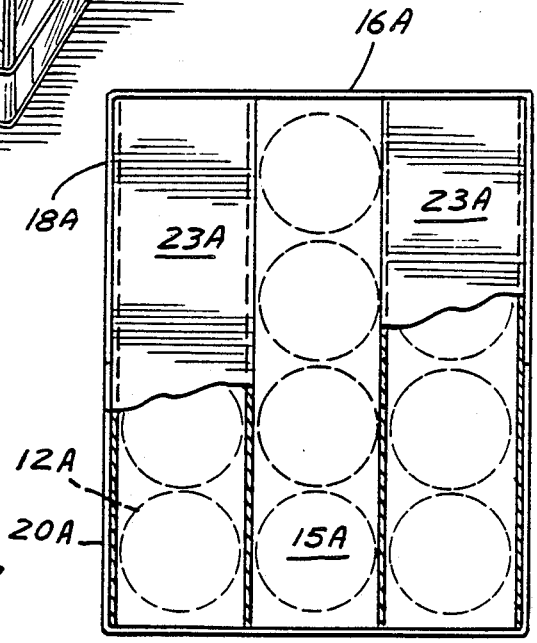
FIG. 9 is a top plan view thereof shown partly broken away to reveal underlying structure.
Figure 7:
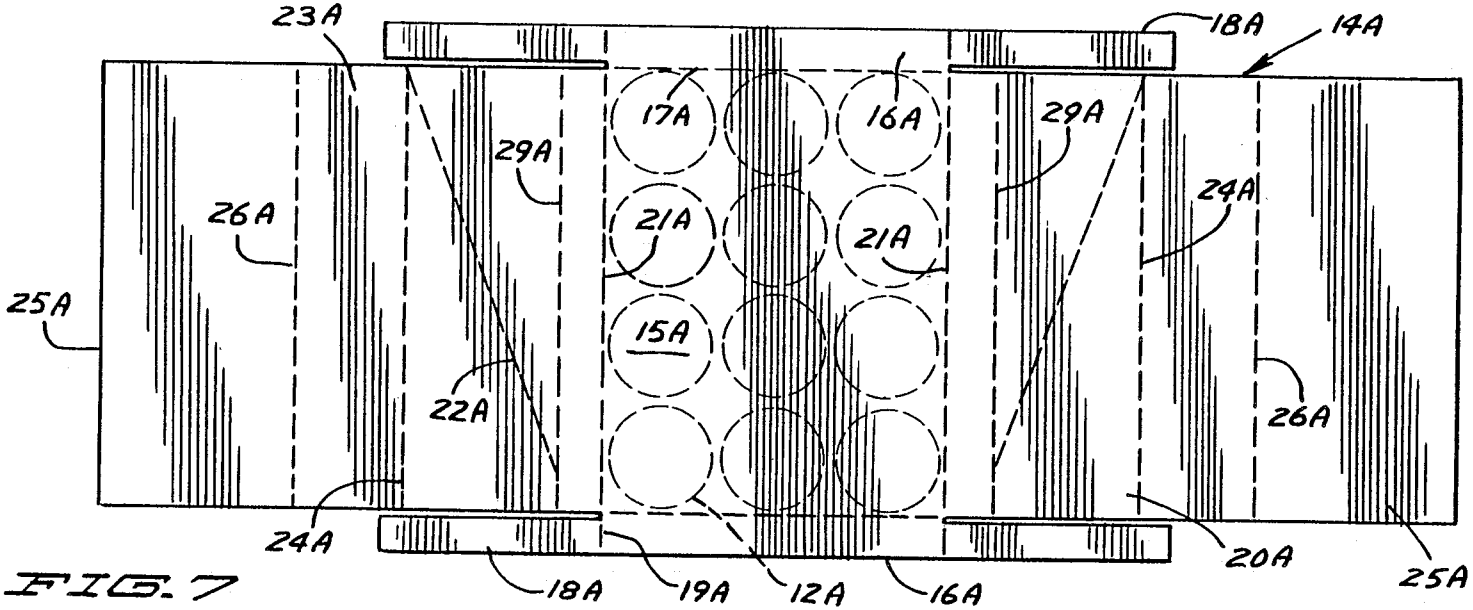
FIG. 7 is a plan view of the blank from which the alternative composite tray and stacker is assembled.
Figure 8:
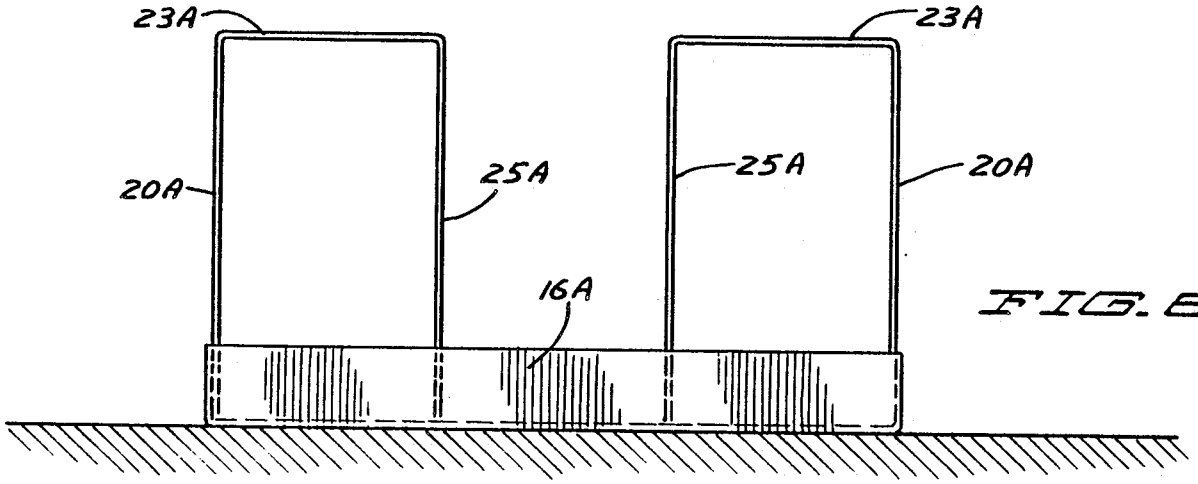
FIG. 8 is a front elevation of the assembled alternative form of package.

Referring now to the drawings, and particularly to FIG. 1, there is shown a pair of typical shrink wrapped packages according to the present invention, indicated generally at 10, stacked one upon the other. The package includes a shallow tray portion and an integral stacker structure formed from a single sheet of stiff sheet material. A plurality of identical paperboard and/or plastic product containers 12 are supported within the tray portion of the package. A shrunken plastic film 13 extends partially or completely around the assembled tray and stacker and containers, as is well known in the art.

Referring to FIG. 2, there is shown a blank 14 from which the composite tray and stacker is assembled. The blank includes a rectangular tray bottom wall section 15 having a pair of narrow side wall sections 16 connected thereto on opposite sides by parallel spaced apart fold lines 17. To facilitate loading, tray bottom wall 15 and side walls 16 preferably have a central transverse reverse fold line 28. Each side wall 16 has a fastening tab 18 at each end, connected to the side walls by fold lines 19. In the assembled structure, tabs 18 are adapted to be bent around the corner of the shallow tray portion of the package and be connected to the tray end walls 20, as by means of adhesive. For increased strength, tabs 18 may be lengthened to extend to the middle of the end walls.

The end wall sections 20 of the blank are connected to the tray bottom wall portion along spaced apart parallel fold lines 21. The end wall sections 20 are preferably perforated diagonally along a line 22 extending from one corner spaced from the bottom wall section toward the point of attachment of a fastening tab 18, and/or along a line 29 extending across the end wall immediately above the tops of tabs 18. Alternatively, perforation line 29, may be replaced with a tear strip. A pair of spacer elements 23 are each connected along a fold line 24 to the adjacent end wall section 20. Preferably fold line 24 is perforated. A stacker element 25 is connected along a fold line 26 to the next adjacent spacer element 23. The widths of the stacker elements 25 are approximately equal to the widths of the end wall portions 20. In the form shown, the combined widths of the spacer elements 23 are approximately equal to the length of the tray bottom wall. This form of package is adapted to the packaging of containers 12 arrayed on the bottom wall of the tray in an even numbered series of rows.

In assembling the package, the end walls 20 are folded along fold lines 21 to extend vertically relative to the horizontal tray bottom wall 15. The stacker elements 25 are folded along fold lines 26 to extend at right angles to the spacer elements 23 which are folded along fold lines 24 to extend horizontally at right angles relative to the top edges of the side walls 20. To facilitate insertion of the stacker elements between adjacent rows of containers, reverse fold line 28 permits slight humping of the tray bottom wall and separation of the tops of the containers. The side walls 16 are folded along fold lines 17 to similarly extend vertically relative to the tray bottom wall. The side wall end flaps 18 are folded inwardly along fold lines 19 along the bottom edge ends of the side walls 20. In so assembling the package, the weight-bearing stacker elements 25 extend vertically downwardly to the tray bottom wall, as shown in FIG. 3. The combination of the abutting spacer elements 25 along with side walls 20 permits stacking of packages on top of the package top wall formed by spacer elements 23. Preferably, the abutting stacker elements 25 are joined together in a laminated joint or seam 27 to increase the weight-bearing capability of the abutting stacker elements. For maximum load strength, the adhesive is preferably applied by wiping over substantially the entire abutting surface of the stacker element.

The blank 14 is composed essentially of stiff sheet material, such as corrugated cardboard as is commonly used in the packaging industry. Ordinarily, where the shrink wrapped packages are intended to be stored with the shallow trays disposed horizontally and stacked one on top of the other, the corrugations extend vertically for maximum strength. In some specialized situations, as in the packaging of prepared food for microwave heating, it is customary to store the shrink wrapped packages for a period of time on what is normally the front or back of the package, followed by stacking in the usual manner. For this specialized use, the blank may be cut with the corrugations extending transversely of the blank rather than longitudinally. The laminated joints 27 and the fastening joints between tabs 18 and end walls 20 are made with glue or other adhesives, as are commonly used in the packaging industry.

When the shrink wrapped package is opened at the store for shelving or free-standing display of the packaged goods, the stacker structure is readily removed by tearing along perforated fold line 24. For greater visibility of the packaged goods, the end walls may also be partially removed by tearing along perforations 22 or 29.

Referring now to FIGS. 6 through 9, there is shown an alternative form of shrink wrapped package according to the present invention including a composite tray and stacker structure. The alternative package is intended for containers which are arrayed in the tray in an odd numbered series of rows, such as three, as illustrated. This alternative form of package 10A includes an integral tray and stacker structure enclosing a plurality of identical product containers 12A, the whole package being enveloped within an outer shrink wrap 13A.

The alternative blank 14A includes a tray bottom wall 15A having side walls 16A connected thereto along fold lines 17A as heretofore described. The ends of the side walls include projecting fastening tabs 18A connected to the side walls along fold lines 19A. While shown long enough to extend to the middle of the end walls, the tabs 18A may be shorter where maximum strength is not essential. The package end walls 20A are connected to the tray bottom wall along fold lines 2A, the spacer elements 23A are connected to the end walls along fold lines 24A, and the stacker elements 25A are connected to the spacer elements along fold lines 26A. Preferably end walls 20A are perforated diagonally along line 22A and/or line 29A and preferably fold line 24A is perforated.

In this alternative form of package, the widths of stacker elements 25A are the same as the widths of end walls 20A. However, the widths of spacer elements 23A are less than in package 10 previously described. For example, the width of each spacer element 23A may be approximately one-third of the length of tray bottom wall 15A. Thus, in the illustrated example in which the containers 12A are disposed in three rows of four each, the single stacker elements 25A are disposed between spaced apart rows of containers 12A instead of abutting. In this instance, the weight of stacked packages is borne by end walls 20A and stacker elements 25A, the spacer elements 23A forming a discontinuous package top wall. In all other respects, package 10A is the same as package 10, previously described.

Although the composite tray and stacker structure according to the present invention is intended mainly for use in shrink wrapped packages, there may be circumstances in which shrink wrapping is unnecessary. For example, a stack of unwrapped packages in a palletized load may be stretch wrapped as a unit without the necessity of wrapping each individual package.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A composite tray and stacker structure mainly for a shrink wrapped package of a plurality of identical containers, said structure comprising:

(A) a rectangular tray bottom wall;

(B) a pair of relatively narrow side walls connected to opposite sides of said bottom wall along spaced apart parallel fold lines, said side walls each having a pair of fastening tabs foldably connected thereto at opposite ends;

(C) a central transverse reverse fold line across the tray bottom wall and side walls;

(D) a pair of relatively wider rectangular end walls connected along their bottom edges to opposite ends of said bottom wall along spaced apart parallel fold lines, said end walls being of a width approximately equal to the height of the containers to be packaged, and being engageable by the fastening tabs of said side walls;

(E) a pair of rectangular spacer elements each connected along one edge to one of said end walls along a fold line at the top edge of each of the end walls, the width of said spacer elements being approximately one-half the length of said walls, whereby in the assembled package said stacker elements are in face-to-face abutment; and (F) a pair of rectangular weight-bearing stacker elements each connected to one of said spacer elements along a fold line along the opposite edge thereof, the width of said stacker elements being approximately equal to the width of the end walls.

2. A composite tray and stacker structure according to claim 1 wherein said stacker elements in face-to-face abutment are connected in a laminated joint.

3. A composite tray and stacker structure according to claim 1 wherein the width of said spacer elements is approximately one-third the length of said side walls, whereby in the assembled package said stacker elements are in spaced apart parallel relationship.

4. A composite tray and stacker structure according to claim 1 wherein the fold lines between the top edges of said end walls and spacer elements are perforated.

5. A composite tray and stacker structure according to claim 1 wherein said end walls are each perforated diagonally from the back top edge to the top of the fastening tab of the front side wall engaging the end wall.

6. A composite tray and stacker structure according to claim 1 wherein said end walls are each perforated along a line parallel to the fold line between the bottom tray wall and end wall and spaced therefrom by approximately the width of said fastening tabs.

7. A composite tray and stacker structure according to claim 1 wherein said structure is comprised of corrugated board, the corrugations of which extend parallel to the direction of the package side walls, whereby the package has maximum load bearing capability when stacked with its bottom wall horizontal.

8. A composite tray and stacker structure according to claim 1 wherein said structure is comprised of corrugated board, the corrugations of which extend at right angles to the direction of the package side walls, whereby the package has maximum load-bearing capability when stacked, on its side walls.

9. In combination:

(A) a composite tray and stacker structure according to claim 1;

(B) a plurality of identical product containers supported in aligned rows on the bottom wall of the tray between the side and end walls thereof, the stacker elements separating at least two adjacent rows of said containers; and (C) a plastic shrink wrap surrounding said tray, stacker elements and containers.

10. In combination:

(A) a composite tray and stacker structure according to claim 2:

(B) a plurality of identical product containers supported in two aligned rows on the bottom wall of the tray between the side and end walls thereof, the stacker elements separating said two adjacent rows of said containers; and (C) a plastic shrink wrap surrounding said tray, stacker elements and containers.

11. In combination:

(A) a composite tray and stacker structure according to claim 3:

(B) a plurality of identical product containers supported in three aligned rows on the bottom wall of the tray between the side and end walls thereof, the stacker elements separating each of the adjacent rows of said containers; and (C) a plastic shrink wrap surrounding said tray, stacker elements and containers.

* * * * *

UNITED STATES PATENT AND TRADEMARK OFFICE

CERTIFICATE OF CORRECTION

PATENT NO. : 4,998,615

DATED : March 12, 1991

INVENTOR(S) : Robert M. Bryan

It is certified that error appears in the above-identified patent and that said Letters Patent is hereby corrected as shown below:

Column 4, line 16, "2A" should be --- 21A ---.

Column 5, line 7, after "said" insert --- side ---.

Signed and Sealed this

Twenty-fifth Day of August, 1992

*Attest:*

DOUGLAS B. COMER

*Attesting Officer*

*Acting Commissioner of Patents and Trademarks*